US007810357B2

(12) United States Patent
Stingel et al.

(10) Patent No.: US 7,810,357 B2
(45) Date of Patent: Oct. 12, 2010

(54) KNITTING MACHINE WITHOUT HOLDING-DOWN SINKERS

(75) Inventors: Uwe Stingel, Meμstetten (DE); Frank Weihing, Gomaringen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/629,173

(22) Filed: Dec. 2, 2009

(65) Prior Publication Data

US 2010/0147035 A1 Jun. 17, 2010

(30) Foreign Application Priority Data

Dec. 12, 2008 (EP) ..... 08171576

(51) Int. Cl.
*D04B 15/08* (2006.01)

(52) U.S. Cl. ..... 66/111; 66/141

(58) Field of Classification Search ..... 66/141, 66/111, 136, 142

See application file for complete search history.

(56) References Cited

U.S. PATENT DOCUMENTS

| | | | | | |
|---|---|---|---|---|---|
| 622,542 | A * | 4/1899 | Ruth | ..... | 66/143 |
| 1,116,190 | A | 11/1914 | Williams | | |
| 3,916,650 | A * | 11/1975 | Schmidt et al. | ..... | 66/111 |
| 4,441,339 | A * | 4/1984 | Yorisue | ..... | 66/111 |
| 4,688,401 | A * | 8/1987 | Kuhn et al. | ..... | 66/141 |
| 4,916,925 | A * | 4/1990 | Pernick | ..... | 66/141 |
| 5,127,241 | A * | 7/1992 | Plath | ..... | 66/141 |
| 6,907,758 | B2 * | 6/2005 | Traenkle et al. | ..... | 66/141 |

FOREIGN PATENT DOCUMENTS

| | | | |
|---|---|---|---|
| EP | 1 087 049 | A2 | 3/2001 |
| FR | 1 220 206 | A | 5/1960 |
| GB | 471694 | | 9/1937 |
| WO | WO 2007/074486 | A1 | 7/2007 |

OTHER PUBLICATIONS

European Search Report issued Feb. 4, 2009, in related European Application No. 08171576.5 (5 pages).

* cited by examiner

*Primary Examiner*—Danny Worrell
(74) *Attorney, Agent, or Firm*—Robert P. Michal, Esq.; Lucas & Mercanti, LLP

(57) ABSTRACT

A knitting machine in accordance with the invention includes a thread guide that is associated with a runner. The runner is disposed to hold open the latches of driven out needles of a first group while the needles of a second group are being driven out. Due to the time-staggered driving-out of the latch-type needles and of a first group and a second group, and due to the alternating arrangement of the needles of the first group and the second group, a rising of the knit fabric while the needles are being driven out is prevented without the assistance of holding-down/knock-over sinkers. Inasmuch as a runner that is separate from the thread guide is used for holding open the latches, the position of said runner can be optimally adjusted independent of the position of the thread guide.

10 Claims, 3 Drawing Sheets

KNITTING MACHINE WITHOUT HOLDING-DOWN SINKERS

CROSS-REFERENCE TO RELATED APPLICATION

This application claims the benefit under 35 USC 119 of European Patent Application No. 08 171 576.5 filed Dec. 12, 2008, the entire disclosure of which is incorporated herein by reference.

FIELD OF THE INVENTION

The invention relates to a knitting machine, in particular a circular knitting machine, that does not require holding-down sinkers for operation.

BACKGROUND INFORMATION

Usually, circular knitting machines comprise a knitting cylinder having a large number of circumferential needle channels that extend in longitudinal direction of the cylinder. Seated in each of these needle channels are knitting needles, usually latch-type needles. The knitting needles are moved back and forth in the needle channels. This is accomplished with cam assemblies or cam components that are accommodated in cam segments and form the cam housing. This cam housing encloses the needle cylinder and comprises at least one guide path. The knitting needles have feet that run on the guide path and thus impart the knitting needles with the required longitudinal back-and-forth longitudinal movement when the knitting cylinder is being rotated.

Thread is fed to the knitting needles of the rotating knitting cylinder via a thread guide that, as a rule, is stationary. For example, a hose-like knit fabric is formed, said knit fabric hanging from the knitting needles.

In order to prevent the knit fabric from moving up when the knitting needles are driven out, hold-down/knock-over sinkers are usually arranged in the vicinity of the knitting needles. The holding-down/knock-over sinkers involve a not inconsiderable constructional effort. In addition, they require constructional space that can restrict the fineness division in knitting machines.

Document WO 2007/074486 A1 discloses a knitting machine that can operate without holding-down/knock-over sinkers. For this purpose, the knitting needles of the needle cylinder are divided into two groups and are driven by different guide cams of the needle cam assembly. For example, first the even-numbered knitting needles are driven out while the not even-numbered knitting needles arranged in between the are not yet driven out and, as a result of this take over the function of holding down the knit fabric. After the even-numbered knitting needles have been driven out, the odd-numbered knitting needles are driven out, whereupon, finally, the knitting needles are retracted one after the other, i.e., the even-numbered knitting needles as well as the odd-numbered knitting needles, in order to form stitches.

Considering such a knitting machine, the open latches of the knitting needles may abut against other machine elements such as, for example, the thread guide. This may result in a wear of the knitting needles. In addition, the latches of the already driven out knitting needles are to be held in open position at specific locations on their way.

OBJECT AND SUMMARY OF THE INVENTION

The object of the invention is to create an improved thread guide for such a knitting machine.

In accordance with the present invention, this object has been achieved with the thread guide in accordance with claim 1. The thread guide of the knitting machine in accordance with the invention is associated with a runner that has a sliding surface for the latches of the latch-type needles. The runner is positioned in such a manner that the latches of the arriving knitting needles start up gently on their sliding surface and, wherever necessary, are held in open position. Preferably, the runner extends in circumferential direction of the knitting cylinder, i.e., in a direction that has been pre-specified by the circumferential movement of the knitting cylinder. Preferably, the runner has a rounded tip that forms a start-up surface aligned diagonally with respect to the direction of movement of the knitting needles. A free space is provided between the tip of the runner and the thread guide.

The runner and also the thread guide can be used to hold the open latches of the driven-out latch-type needles in open position. To accomplish this, the thread guide may have a sliding surface for the latches of the latch-type needles. The sliding surface of said thread guide is, preferably, a smooth, stepless surface, along which the latches of the latch-type needles may slide when the driven-out latch-type needles are moving relative to the thread guide as a result of a relative rotation of the knitting cylinder. In so doing, the sliding surface of the thread guide preferably extends in circumferential direction, whereby it may have a contour that approximately follows the path taken by the driven-out knitting needles.

A free space is preferably provided between the runner and the thread guide. This free space is instrumentally defined by the positioning between the runner and the thread guide. For example, the free space between the tip of the runner and the thread guide can be enlarged in order to obtain more space for the latch movement in this free space. This allows the latches of the latch-type needles to pivot into this free space during the driving-out movement, without abutting against the runner or the thread guide. The adjustment of the runner relative to the thread guide is a function of the settings of the knitting machine and the yarn that is to be processed.

The thread guide in accordance with the invention can perform three functions. First, it is disposed to supply the knitting site with thread. Then, it may be configured or adjusted in such a manner that it holds down the latch of every second needle in rearward position while the remaining needles are being driven out. In addition, said thread guide can hold open the latches of the needles that already been driven out.

It is also possible to divide the functions between the thread guide and the runner in the following manner. The thread guide guides the thread and covers the latches that have been driven out. The additionally provided runner performs the function of holding down the latches of the already first driven-out needles in such a manner that a secured holding-down of the knit goods is ensured when the remaining needles are being driven out during the subsequent driving-out operation.

Preferably, the runner is arranged so as to be adjustable relative to the thread guide. In so doing, all three of the aforementioned functions of the thread guide are fulfilled to make the manufacture of the most diverse weaves and patterns and processing of diverse yarns is possible. In addition, an optimal adjustment of the thread-feeding and holding-down function is possible, namely, independent of each other.

The runner acts as a latch holding-down element. By separating this function from the function of the thread guide, the option of an adjustment of the latch holding-down function independent of the thread guide becomes possible.

The runner may be connected with the thread guide, preferably via an adjustable holding device. Alternatively, the runner may be coupled with other machine components such as, for example, a segment of the needle cam assembly.

Usually, a coulier edge is provided on the needle cylinder. In order to automatically compensate for changed coulier settings and consequently for changes of the needle position and latch impact, the runner may additionally be joined to the central couliering. For example, this may be done in that the runner is connected to the bearing of the knitting cylinder by means of a suitable rack.

If the runner is not connected to the thread guide, it also becomes possible to adjust the distance between the runner and the needles—independently of the thread guide—and thus, for example, create room for the opening latches of those needles that are being driven out after the first group of needles has already been driven out.

Furthermore, it may practical to provide sliding surfaces on the latches of the needles, said sliding surfaces sliding along the sliding surfaces of the runner and/or the thread guide and thus providing a closing reserve.

Additional details of advantageous embodiments of the invention are obvious from the description, the drawings or the sub-claims. The description is restricted to essential aspects of the invention and miscellaneous situations. The drawings should be used for supplementary reference.

The features and advantages of the claimed invention will become apparent from the following description of preferred embodiments of the invention, given by way of example only, which is made with reference to the accompanying drawings.

DESCRIPTION OF THE PREFERRED EMBODIMENT

Figure 1:
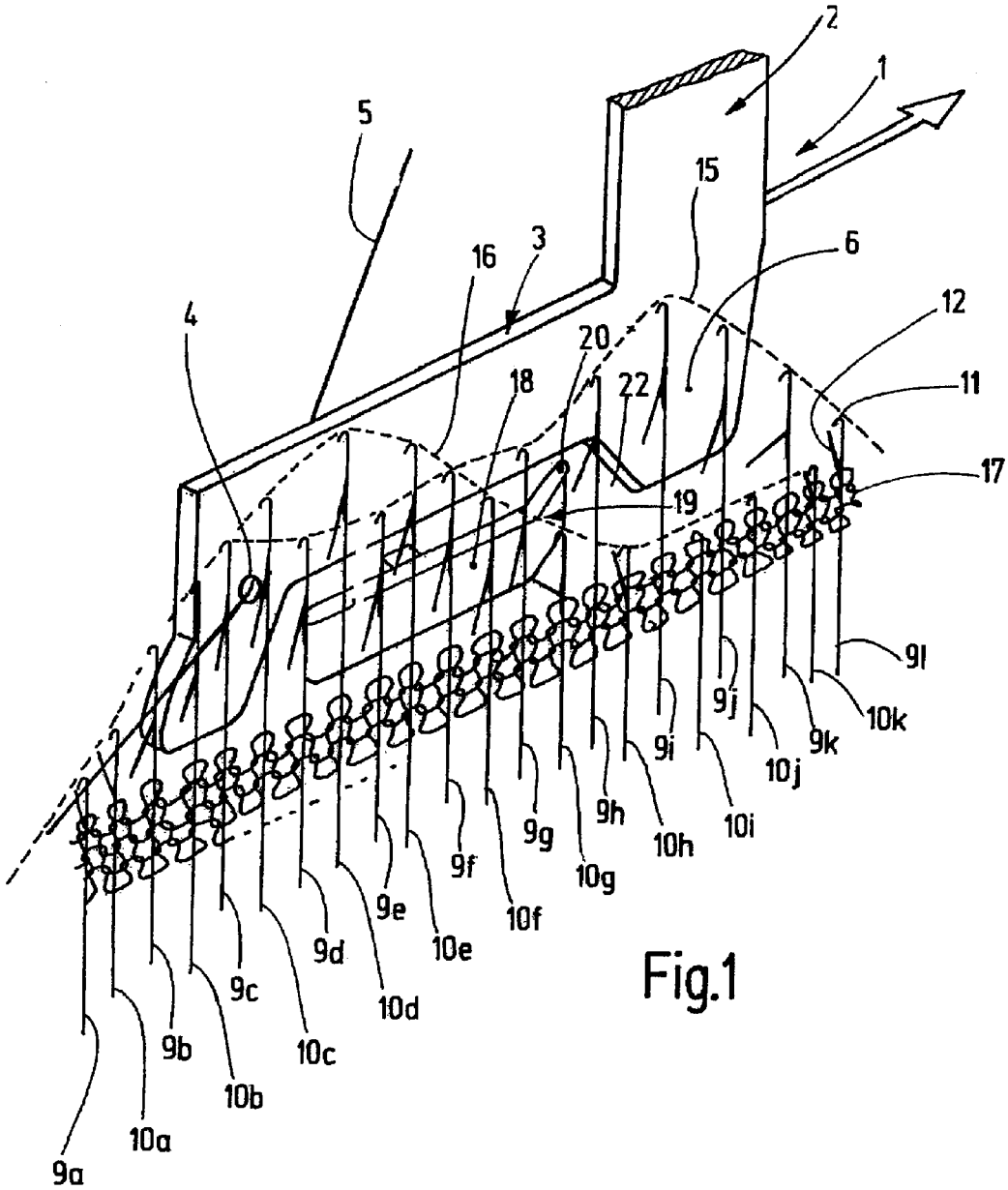
FIG. 1 is a schematized perspective illustration, viewed radially outward from the central axis of the knitting cylinder, of a knitting site of a circular knitting machine comprising thread guides and needles as well as knit fabric.

FIG. 1 shows a knitting site of a knitting machine. The knitting site is defined by a thread guide 1 that is preferably held in an essentially stationary manner on the knitting machine. It has a holding leg 2 and a section 3 extending, preferably in approximately horizontal direction, away from said holding leg. On its free end, section 3 is provided with at least one eyelet 4, that is configured, for example, as a passage opening, through which the thread 5 is fed to the knitting site. In particular on its section 3, the thread guide 1 has a preferably stepless and smooth sliding surface 6.

Furthermore, the knitting machine comprises knitting needles that are only schematically indicated in FIG. 1. As is obvious—in part—from FIG. 3, said knitting needles are supported in the needle channels 7 of a knitting cylinder so as to be movable in vertical direction. In conjunction with this, "vertical" is understood to mean at least one direction that is essentially parallel to the rotational axis of the knitting cylinder.

Seated in the needle channels 7 are latch-type needles 9, 10 that are provided with a letter index for better differentiation in FIG. 1. The latch-type needles 9 belong to a first group, and the latch-type needles 10 belong to a second group. Each latch-type needle 9, 10 has, on its upper end, a hook 11 that is associated with a pivotally supported latch 12. The latch 12 can open and close the hook 11.

Figure 2:
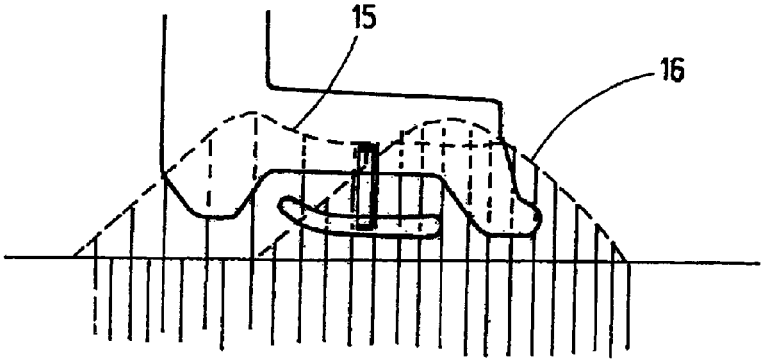
FIG. 2 is a side view, viewed radially inward, of the knitting site in accordance with FIG. 1.
Figures 3, 4:
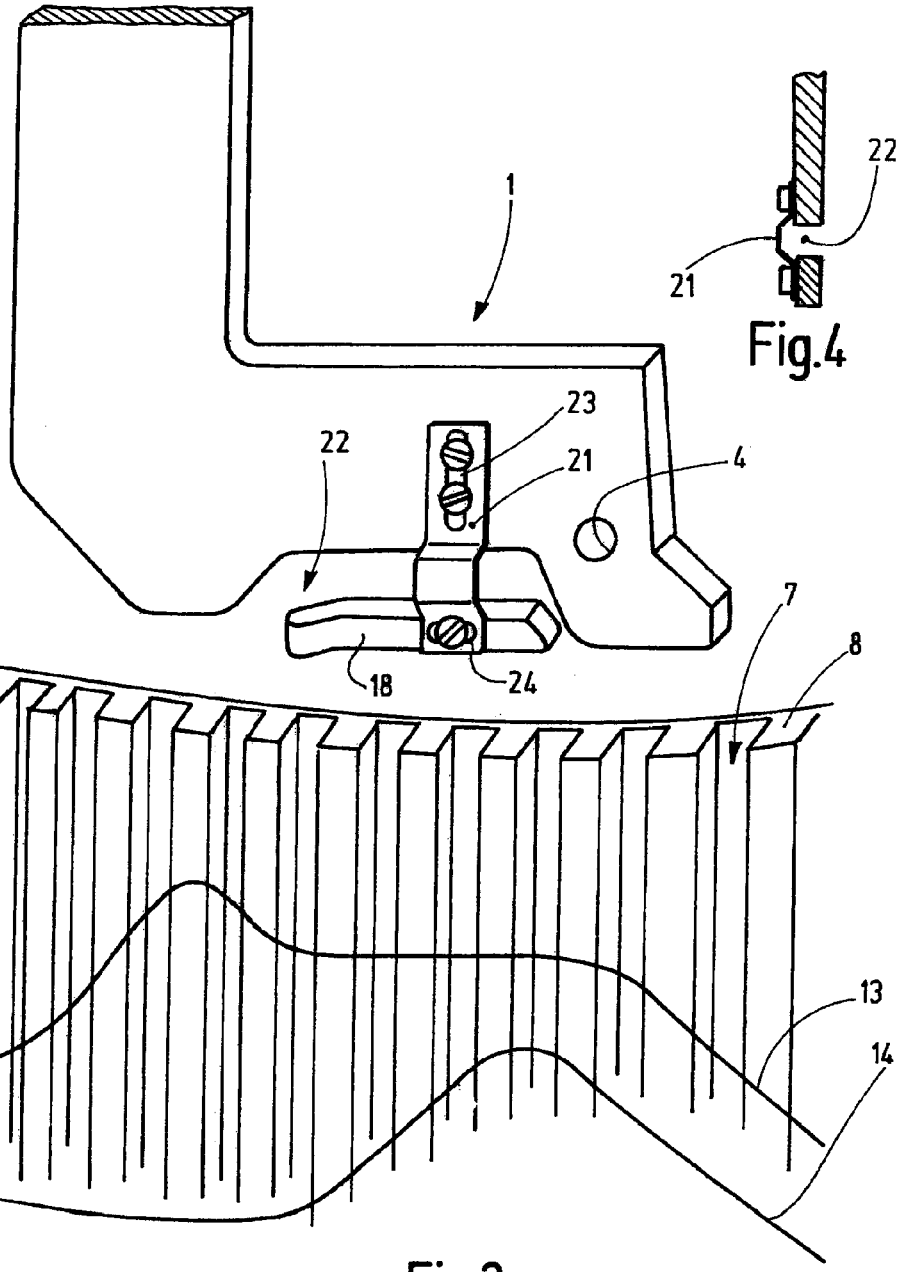
FIG. 3 is a perspective and partially schematized illustration, viewed radially inward, of the knitting site in accordance with FIG. 1 without needles.
FIG. 4 is a schematized vertical sectional illustration of the thread guide and its runner.

The latch-type needles 9, 10 are driven out by a rotation of the knitting cylinder 8, whereby their feet are in contact with various cam curves or a needle cam. To do so, the latch-type needles 9 have their driving foot at a location that is different from that of the latch-type needles 10. In FIG. 3, various cam curves 13, 14 are schematically indicated. The cam curves 13, 14 are guide paths that are directly provided on the so-called knitting cam assembly that encloses the knitting cylinder like a ring. If the knitting cylinder 8 continuously moves the feet of the latch-type needles 9, 10 on the inactive cam curves 13, 14, the latch-type needles 9, 10 of the two groups are being moved—as indicated in FIGS. 1 and 2—along different curves 15, 16, in order to effect the knitting operation to produce a knit fabric 17. The knitting needles 9, 10 located under the thread guide 1 form a knitting site.

The thread guide 1 has on its lower edge, for example, an approximately trapeze-shaped recess in which a runner 18 is 15 arranged. This runner 18 is disposed to hold the latches 12 of the driven-out latch-type needles 9, 10 in open position. To do so, the runner has a smooth sliding surface 19, said sliding surface facing the latch-type needles 9, 10. On one end 20, where the latch-type needles 9, 10 arrive in the course of the knitting operation, the runner may have a part that is bent away from the needles. The section of the sliding surface 19 that extends onto this part forms a start-up slope for the subsequent latches 12.

For example, the runner 18 may be fastened to the thread guide 1. This may be accomplished, with a bracket 21 as shown in FIGS. 3 and 4, said bracket bridging the free space 22, 22' between the runner 19 and the thread guide 1. Preferably, the bracket 21 is bent outward, i.e., away from the latch-type needles 9, 10, in order to leave clear the free space 22, 22' and to prevent the latches 12 extending through the free space 22 from abutting against the bracket 21.

Preferably, the bracket 21 represents an adjustable holding device with elongated holes 23, 24 on both ends of the bracket 21, whereby the elongated holes 23, 24 extend in different directions. Fastening screws extend through said elongated holes. Because of the elongated holes 23, 24, the runner 18 can be adjusted in longitudinal direction of the runner and in vertical direction or longitudinal direction of the needle.

Figure 5:
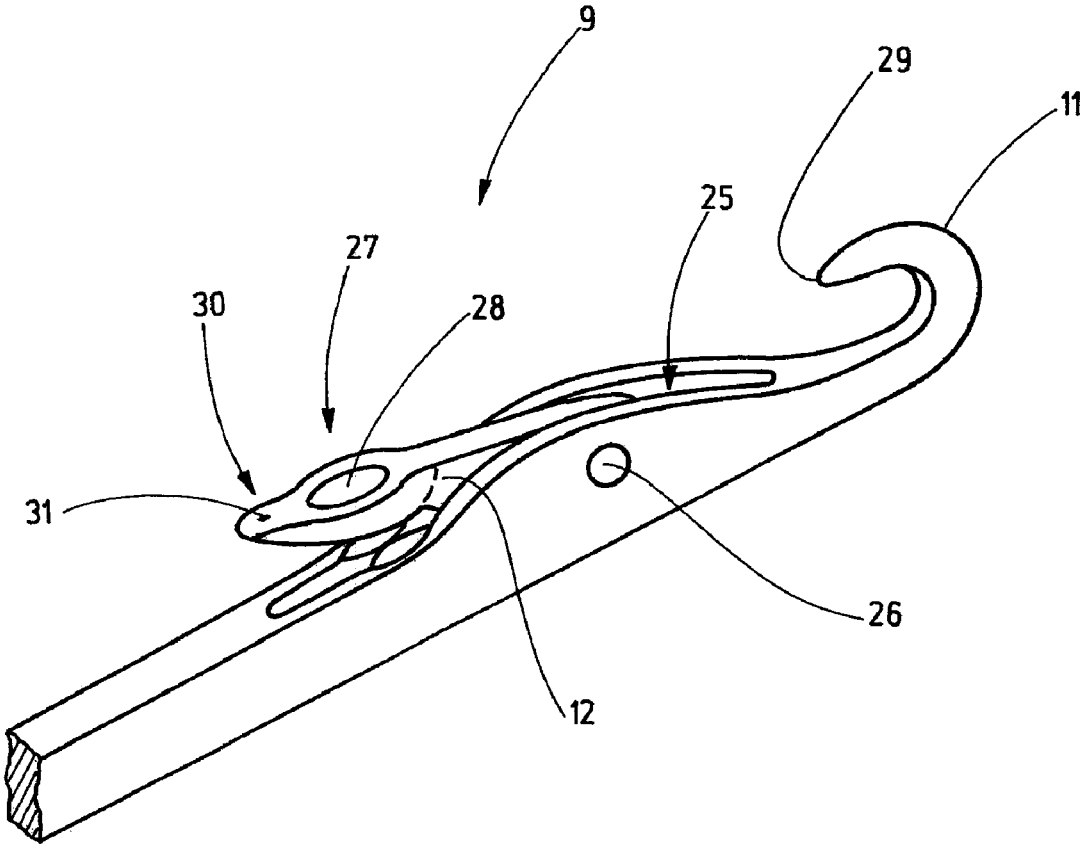
FIG. 5 is a latch-type needle for use in a knitting machine having the configuration as is obvious from FIGS. 1 through 4.

The knitting machine may be loaded with conventional latch-type needles. However, preferably used are latch-type needles that resemble the latch-type needle 9 shown in FIG. 5. The special feature of the latch-type needle 9 is the configuration of the latch 12. Like a common latch, it is pivotally supported in a latch slot 25. A pin 26 acts as the support. The latch 12 has, on its end, a spoon-shaped latch head 27 with a recess 28 that is also referred to as a "saw cut." The depth and the position of the recess 28 are dimensioned in such a manner that the recess 28 of the closing latch covers the tip 29 of the hook 11.

The special feature of the latch 12 is its wearing section or sliding section 30 having a crowned wearing or sliding surface 31. In continuation of the latch shank, the sliding section 30 extends like a projection, in approximately radial direction, toward the pin 26 and away from the latch head 27. On the side adjacent to the recess 28, the preferably crowned sliding surface 31 is provided, which surface may, in particular, come into sliding contact with the sliding surface 19 of the runner 18. Any wear on the sliding surface 31 that occurs with increasing age of the latch-type needle 9 does not lead to sharp edges because of the curvature of said sliding surface and thus does not make the latch-type needle 9 inoperative.

The knitting machine 1 described so far operates as follows:

FIG. 1 illustrates the knitting operation. The latch-type needles 9 and 10 of the two different groups are moved differently due to the action of the cam curves 13, 14 during the rotation of the knitting cylinder. The movements are marked by curves 15, 16 in FIG. 1. First, the needles 9 are driven out so that their hooks 11 move on curve 15. One after the other, each needle assumes the positions of the latch-type needles 9*l*, 9*k*, 9*j*, etc., through 9*h*. First, the needles 10 of the other group do not remain in the driven out state as is shown in the right part of FIG. 1. They hold down or keep below the knit fabric 17. While they are driven out, the latch and the inside space of the hook are opened. The pivot range of the latch is defined by the free space 22'. During the driving-out movement, the latch-type needles 10 follow the path of the latch-type needles 10*h*, 10*g*, 10*f*, 10*e*, etc. At the same time, the latch-type needles 9 move into the positions of the latch-type needles 9*h*, 9*g*, 9*f*, 9*c*, whereby the open latches slide along the sliding surface 19 of the runner 18. As a result of this, said latches are held open and prevent a rising of the knit fabric while the latch-type needles 10 of the other group are driven out. Finally, as shown on the left side of FIG. 1, all the latch-type needles 9 and 10 are moving past the eyelet 4 above, catch the thread 5 and are pulled back in order to each form new stitches. The curves 15 and 16 are superimposed in this region.

A knitting machine in accordance with the invention comprises a thread guide 1 that is associated with a runner 18. The runner 18 is disposed to hold open the latches of driven out needles of a first group while the needles of a second group are being driven out. Due to the time-staggered driving-out of the latch-type needles 9 and 10 of a first group and a second group, and due to the alternating arrangement of the needles of the first group and the second group, a rising of the knit fabric while the needles are being driven out is prevented without the assistance of holding-down/knock-over sinkers. Inasmuch as a runner 18 that is separate from the thread guide 1 is used for holding open the latches, the position of said runner 18 can be optimally adjusted independent of the position of the thread guide.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A circular knitting machine, comprising:

a knitting cylinder having needle channels for latch-type needles, a thread guide having an eyelet for feeding the thread to a knitting site, and a runner that also has a sliding surface for the latches of the latch-type needles, wherein the runner is supported by a holding device that bridges a free space and is bent away therefrom.

2. A circular knitting machine in accordance with claim 1, wherein the free space is provided between the thread guide and the runner.

3. A circular knitting machine in accordance with claim 1, wherein the thread guide has at least one sliding surface for the latches of the latch-type needles.

4. A circular knitting machine in accordance with claim 1, wherein the latch-type needles are associated with different guide paths in the cam assembly housing of the knitting machine so that the latch-type needles belong to two groups that are moved differently.

5. A circular knitting machine in accordance with claim 1, wherein the latch-type needles of the first group are alternately arranged with the latch-type needles of the second group.

6. A circular knitting machine in accordance with claim 1, wherein the runner is arranged in a recess of the thread guide.

7. A circular knitting machine in accordance claim 1, wherein the runner is connected with the thread guide.

8. A circular knitting machine in accordance with claim 1, wherein the runner is supported so as to be movable in a longitudinal direction.

9. A circular knitting machine in accordance with claim 1, wherein the runner is supported so as to be movable in a vertical direction.

10. A circular knitting machine in accordance with claim 1, wherein the runner is supported by a knitting cam assembly whereby the curves of said cam assembly control the latch-type needles.

* * * * *